US008869317B2

(12) United States Patent
Gu

(10) Patent No.: US 8,869,317 B2
(45) Date of Patent: Oct. 28, 2014

(54) BUOYANCY OPERATION MECHANISM FOR SEWAGE SUCTION DEVICE USED IN TOILETS

(76) Inventor: Guoqing Gu, Edison, NJ (US)

( * ) Notice: Subject to any disclaimer, the term of this patent is extended or adjusted under 35 U.S.C. 154(b) by 455 days.

(21) Appl. No.: 13/387,038

(22) PCT Filed: Feb. 28, 2011

(86) PCT No.: PCT/CN2011/071380

§ 371 (c)(1),
(2), (4) Date: Jan. 25, 2012

(87) PCT Pub. No.: WO2011/113322

PCT Pub. Date: Sep. 22, 2011

(65) Prior Publication Data

US 2012/0124729 A1 May 24, 2012

(30) Foreign Application Priority Data

Mar. 17, 2010 (CN) ..... 2010 1 0126268

(51) Int. Cl.

| | |
|---|---|
| ***E03D 11/10*** | (2006.01) |
| ***E03D 11/00*** | (2006.01) |
| ***E03F 1/00*** | (2006.01) |
| ***E03D 5/012*** | (2006.01) |

(52) U.S. Cl.

CPC ..... *E03D 11/10* (2013.01); *E03F 1/006* (2013.01); *E03D 5/012* (2013.01)

USPC ..... 4/431; 4/434

(58) Field of Classification Search

USPC ..... 4/431, 354

See application file for complete search history.

(56) References Cited

U.S. PATENT DOCUMENTS

| | | | | |
|---|---|---|---|---|
| 1,864,827 | A * | 6/1932 | Jenkins et al. | 4/249 |
| 3,851,338 | A * | 12/1974 | Roosa | 4/373 |
| 4,333,184 | A * | 6/1982 | Wang | 4/313 |
| 6,279,176 | B1 * | 8/2001 | Aviles | 4/354 |
| 7,886,374 | B2 * | 2/2011 | Jun | 4/434 |
| 2009/0320200 | A1 * | 12/2009 | Mukerji | 4/441 |
| 2010/0287692 | A1 * | 11/2010 | Rampen | 4/434 |

* cited by examiner

*Primary Examiner* — Huyen Le
*Assistant Examiner* — Janie Christiansen
(74) *Attorney, Agent, or Firm* — Gearhart Law, LLC

(57) ABSTRACT

This invention discloses a buoyancy operation mechanism for a sewage suction device used in toilet. The mechanism includes: a water tank bottom plate that contains a lower leading pole and a second pulley, the tank wall having an aperture and a first pulley; an upper cover plate having an upper leading pole and a third pulley; a hollow floating box with either a rectangular or circular cross section wherein its center is equipped with a leading hole, a limiting barrier, a first hoist ring and a second hoist ring; a base plate that having a fourth pulley; and a top cover plate. The water tank described above is seated on the base plate, the leading hole of the floating box is positioned over the lower leading pole; the upper cover plate is positioned inside the water tank, and the top cover plate is located on top of the water tank; the first hoist ring of the floating box is tied to the first pulling string and the second hoist ring is tied to the second pulling string where both strings continue outside the water tank. This invention uses the change of liquid level in the water tank during the process of flushing the toilet, wherein the buoyancy operation mechanism automatically controls the sewage suction device to pump and reset by utilizing the pulling strings. The mechanism is compact in structure and convenient in operation.

2 Claims, 2 Drawing Sheets

BUOYANCY OPERATION MECHANISM FOR SEWAGE SUCTION DEVICE USED IN TOILETS

This application is a national application of PCT-application PCT/CN2011/071380 filed on Feburary 28, 2011, which claims priority of the Chinese application CN 201010126268.1 filed on Mar. 17, 2010, both of which are incorporated herein by reference.

FIELD OF INVENTION

This invention relates to the field of sanitary technology for toilets. It is an enhanced sewage waste disposal mechanism that utilizes the change of liquid level in the water tank during the flushing process of toilets. In particular, this is a buoyancy operation mechanism for a sewage suction device used in toilets.

TECHNOLOGY BACKGROUND

In order to conserve water and improve the effectiveness of toilet waste disposal, a strong waste disposal device was added to the end of the toilet siphon to produce high negative pressure, and this has achieved good results in eliminating wastes. However, the remaining problem is: limited by the size of the toilet, the strong waste disposal unit must be installed with control mechanisms such as a pulling string and a control rod among others, and it is controlled manually or through a solenoid valve or through a motor drive. This leads to the complex structure of toilets, the inconvenience in usage and affects its overall appearance.

The purpose of this invention is to provide a buoyancy operation mechanism for a sewage suction device, hence, to overcome what is currently lacking in the existing technology in toilet waste disposal devices. This invention operates via the change of the liquid level in the water tank during the flushing process. The buoyancy operation mechanism automatically controls the sewage suction device to pump and reset by utilizing the pulling strings. This mechanism is compact in structure, convenient in operation and has an overall aesthetically pleasing appearance.

Following is a detailed technical outline of the invention's mechanisms:

The unique features of the buoyancy operation mechanism for a sewage suction device used in toilets include the following:

a water tank wherein its bottom plate is provided with a lower leading pole, a second pulley is located between the bottom plate and the lower leading pole, the tank wall contains an aperture; a first pulley is located outside the water tank adjacent to the aperture;

an upper cover plate having an upper leading pole; a third pulley is positioned on top of the upper cover plate;

a hollow floating box with either a rectangular or circular cross section where its center is equipped with a leading hole; a limiting barrier is located inside the leading hole with a first hoist ring and a second hoist ring positioned on the limiting barrier;

a base plate with a protruding upper level along the edges, where the protruding upper level is provided with a through hole; a fourth pulley is located inside the through hole; and a top cover plate;

wherein the water tank is seated on the protruding upper level of the base plate; the leading hole of the floating box is positioned over the lower leading pole of the water tank; the upper leading pole of the upper cover plate points downward inside the water tank; the top cover plate is positioned on top of the water tank; the first hoist ring of the floating box is tied to a first pulling string, wherein the first pulling string passes over the third pulley and the first pulley, through the aperture, and then continues outside the water tank; the second hoist ring of the floating box is tied to the second pulling string, wherein the second pulling string passes over the second pulley and the fourth pulley, through the through hole, and then continues outside the water tank.

The lower leading pole of the water tank may further comprise a sealing ring.

The current invention uses the change of the liquid level in the water tank during the process of flushing the toilet. The buoyancy operation mechanism automatically controls the sewage suction device to pump and reset by utilizing the pulling strings. The mechanism is compact in structure and convenient in operation.

METHOD OF OPERATION

Figure 1:
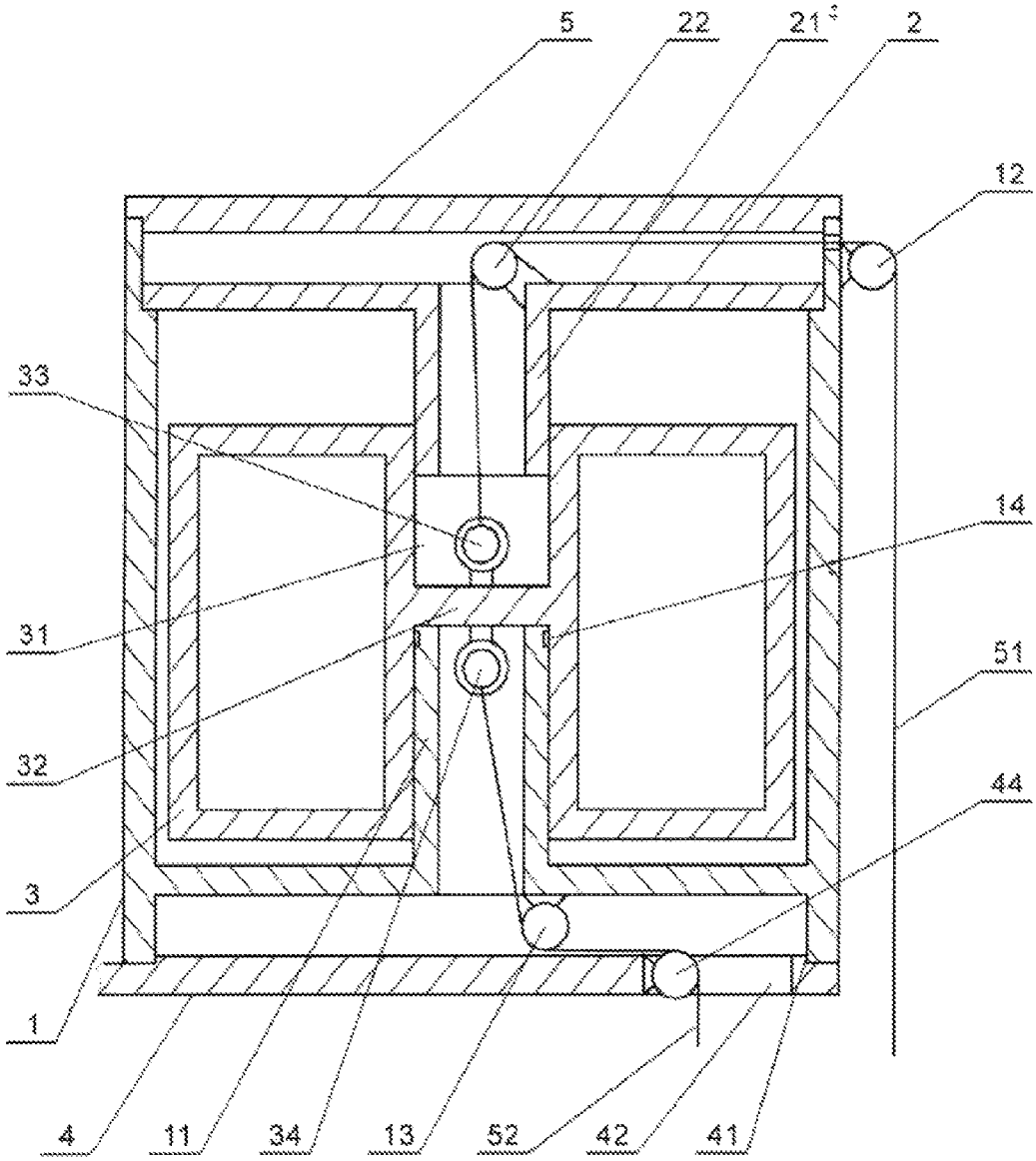
FIG. 1 is the general structural schematic drawing of the invention.

See FIG. 1, the invention includes:

A water tank (1) where its bottom plate is provided with a lower leading pole (11); a second pulley (13) is located between the bottom plate and the lower leading pole (11); the tank wall contains an aperture; a first pulley (12) is located outside the water tank (1) adjacent to the aperture;

An upper cover plate (2) having an upper leading pole (21); a third pulley (22) is positioned on top of the upper cover plate;

A hollow floating box (3) with either a rectangular or circular cross section where its center is equipped with a leading hole (31); a limiting barrier (32) is located inside the leading hole (31) with a first hoist ring (33) and a second hoist ring (34) positioned on the limiting barrier (32);

A base plate (4) with a protruding upper level (41) along the edges, where the protruding upper level (41) is provided with a through hole (42); a fourth pulley (44) is located inside the through hole (42); and A top cover plate (5);

Wherein the water tank (1) is seated on the protruding upper level (41) of the base plate (4); the leading hole (31) of the floating box (3) is positioned over the lower leading pole (11) of the water tank (1); the upper leading pole (21) of the upper cover plate (2) points downward inside the water tank (1); the top cover plate (5) is positioned on top of the water tank (1); the first hoist ring (33) of the floating box (3) is tied to the first pulling string (51), where the first pulling string (51) passes over the third pulley (22), the first pulley (12) and through the aperture and then continues outside the water tank (1); the second hoist ring (34) of the floating box (3) is tied to the second pulling string (52), where the second pulling string (52) passes over the second pulley (13), the fourth pulley (44) and through the through hole (42) and then continues outside the water tank (1).

The lower leading pole (11) of the water tank (1) may further comprise a sealing ring (14).

Figure 2:
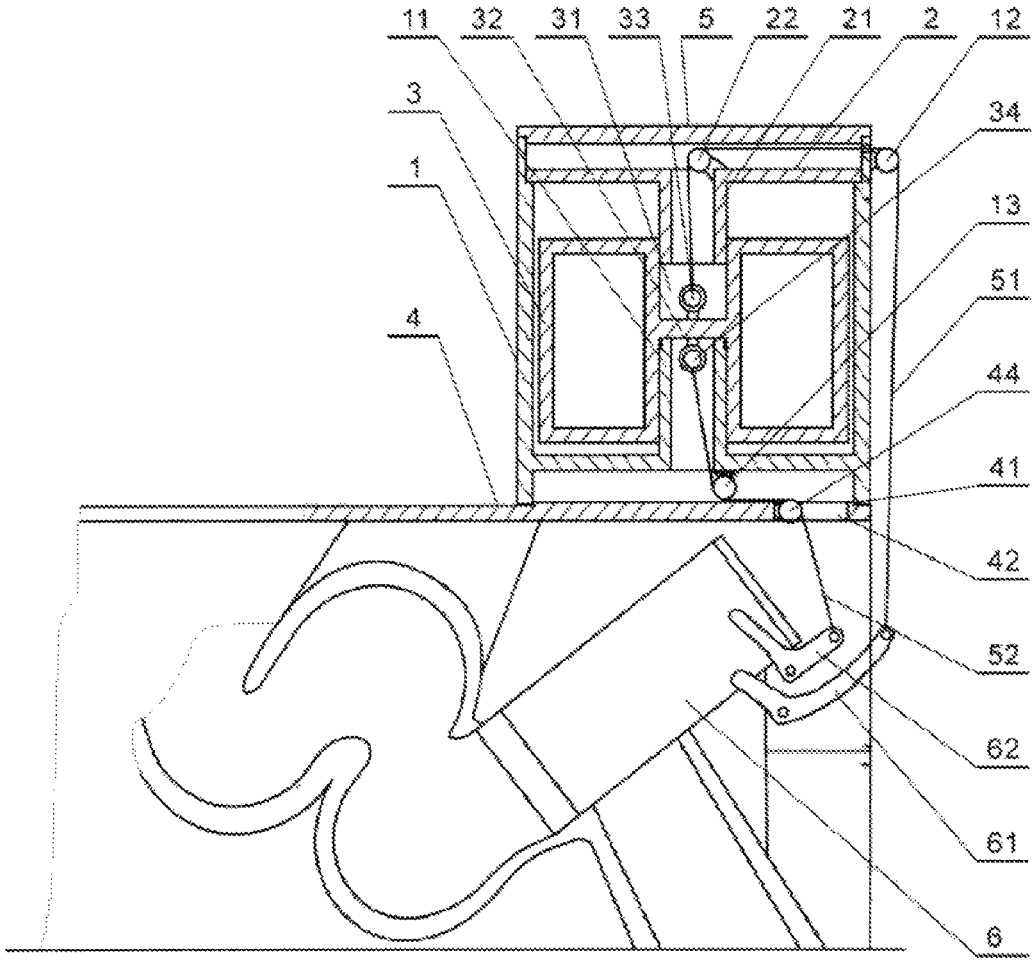
FIG. 2 is the operational schematic drawing of the invention.

The operation of the invention:

See FIG. 2, the invention is connected to a sewage suction device 6 used in toilets: because the first hoist ring (33) of the floating box (3) is tied to the first pulling string (51), and the first pulling string (51) passes over the third pulley (22) and the first pulley (12), and then continues outside the water tank (1), this allows the end of the first pulling string (51) to be connected to the shifting fork rod (61), which is a part of the sewage suction device 6. Simultaneously, because the second hoist ring (34) of the floating box (3) is tied to the second pulling string (52), and the second pulling string (52) passes over the second pulley (13), the fourth pulley (44) and through the through hole (42), then continues outside the water tank (1), this allows the end of the second pulling string (52) to connect to the piston push rod (62) that is a part of the sewage suction device 6.

The invention works in the following way: as the toilet water tank (1) starts accumulating water, the floating box (3) rises under the effect of buoyancy due to the rise of the liquid level inside the water tank (1). At the same time, the second pulling string (52) that is tied to the second hoist ring (34) sets off the piston push rod (62) that is part of the sewage suction device 6. This causes the piston to reset slowly. Consequently, the sewage suction device 6 gradually closes. Meanwhile, the floating box (3) rises continuously up until the limiting barrier (32) is blocked by the upper leading pole (21), this causes the sewage suction device 6 to close completely. As the toilet water tank (1) starts releasing water, the floating box (3) loses its buoyancy and falls under the weight of gravity due to the decrease in water level inside the water tank (1). Concurrently, the first pulling string (51) that is tied to the first hoist ring (33) pulls the shifting fork rod (61) that is part of the sewage suction device 6, and this in turn opens up the lock bolt. This initiates a suction action due to the movement of the piston, and will continue until the piston hits the stop point. This completes sewage pumping and waste disposal of the sewage suction device 6, thus ending the work cycle.

Installed in the invention's water tank is a floating box and a pulling string mechanism. The invention uses the change of liquid level in the water tank during the process of flushing the toilet, along with pulling strings and a flush button to control the pumping and the reset of the sewage suction device. The mechanism is compact in structure, convenient in operation and aesthetically pleasing in appearance.

What is claimed is:

1. A buoyancy operation mechanism for a sewage suction device used in toilets, the mechanism comprising:

a water tank having a bottom plate and a tank wall, wherein the bottom plate has a lower leading pole, a second pulley is located between the bottom plate and the lower leading pole; the tank wall contains an aperture, a first pulley is located outside the water tank adjacent to the aperture;

an upper cover plate having an upper leading pole, wherein a third pulley is positioned on top of the upper cover plate;

a hollow floating box with either a rectangular or circular cross section and a center, where the center is equipped with a leading hole, wherein a limiting barrier is located inside the leading hole with a first hoist ring and a second hoist ring positioned on the limiting barrier;

a base plate having edges, with a protruding upper level along the edges, where the protruding upper level is provided with a through hole, a fourth pulley is located inside the through hole; and a top cover plate, wherein the water tank is seated on the protruding upper level of the base plate; the leading hole of the floating box is positioned over the lower leading pole of the water tank; the upper leading pole of the upper cover plate points downward inside the water tank; the top cover plate is positioned on top of the water tank; the first hoist ring of the floating box is tied to a first pulling string, where the first pulling string passes over the third pulley and the first pulley, through the aperture, then continues outside the water tank; the second hoist ring of the floating box is tied to a second pulling string, wherein the second pulling string passes over the second pulley and the fourth pulley, through the through hole, and then continues outside the water tank.

2. The buoyancy operation mechanism according to claim 1, further comprising a sealing ring located on the lower leading pole of the water tank.

* * * * *